US010494062B2

(12) United States Patent
Kohen et al.

(10) Patent No.: US 10,494,062 B2
(45) Date of Patent: Dec. 3, 2019

(54) MARINE SEAT WITH SAFETY ROLLBACK

(71) Applicants: Robert Kohen, Tampa, FL (US); Kirk Owens, Merritt Island, FL (US)

(72) Inventors: Robert Kohen, Tampa, FL (US); Kirk Owens, Merritt Island, FL (US)

( * ) Notice: Subject to any disclaimer, the term of this patent is extended or adjusted under 35 U.S.C. 154(b) by 223 days.

(21) Appl. No.: 15/809,585

(22) Filed: Nov. 10, 2017

(65) Prior Publication Data

US 2019/0144082 A1 May 16, 2019

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
USPC ..... 297/452.18, 233, 237, 236, 232, 487, 297/488; 292/76, 80, 198; 403/326, 329
See application file for complete search history.

(56) References Cited

U.S. PATENT DOCUMENTS 3,439,889 A 4/1969 Karlsen
3,441,313 A 4/1969 Persson
3,485,519 A 12/1969 Chiu
3,592,493 A 7/1971 Goose
3,634,925 A 1/1972 Van Loo
3,675,970 A 7/1972 Bereday
3,886,611 A 6/1975 Lammy
3,937,641 A 2/1976 Kushner
3,977,800 A 8/1976 Cassel
4,021,129 A 5/1977 Sykes
4,040,665 A 8/1977 Wallace
4,073,538 A 2/1978 Hunter
4,205,879 A 6/1980 Heling
4,544,204 A 10/1985 Schmale
5,131,721 A 7/1992 Okamoto
5,179,063 A 1/1993 Harris et al.
5,265,934 A * 11/1993 Forget ..... B60N 2/309 297/237
5,498,096 A 3/1996 Johnson
5,499,863 A 3/1996 Nakane
5,588,700 A * 12/1996 Homier ..... B60N 2/3084 297/14
5,636,901 A 6/1997 Grilliot
5,810,446 A 9/1998 Tadokoro
5,984,416 A 11/1999 Waldo
6,056,359 A * 5/2000 Clark ..... B63B 29/04 292/76
6,203,101 B1 3/2001 Chou
6,474,738 B1 * 11/2002 Ratza ..... A47C 5/12 297/237
6,672,670 B2 1/2004 Funk
(Continued)

*Primary Examiner* — Mark R Wendell
(74) *Attorney, Agent, or Firm* — Andrew W. Ludy

(57) ABSTRACT

A marine seat assembly is used in connection with a boat. The marine seat assembly comprises a hollow tubular metal frame with an upright portion and a seat portion. A plurality of polymer frame panels is disposed on the frame, using fasteners and adhesive to form a composite structure. A pair of armrests mounted on the frame pivot upward when not used. A bolster is pivotally mounted on bolster hinges for pivotal movement from in front of the seat, to above the seat. The bolster hinges are mounted sufficiently inboard of the bolster sides so as to preclude insertion of fingers in the bolster hinges, thereby avoiding injury.

20 Claims, 10 Drawing Sheets

(56) References Cited

U.S. PATENT DOCUMENTS

| | | | | |
|---|---|---|---|---|
| 6,739,673 | B2 | 5/2004 | Gupta | |
| 6,883,871 | B2 | 4/2005 | Nae | |
| 7,296,858 | B2 | 11/2007 | Ruspa | |
| 7,523,988 | B1 * | 4/2009 | Ratza | B60N 2/24 297/230.14 |
| 8,539,661 | B2 | 9/2013 | Gross | |
| 9,126,518 | B2 | 9/2015 | Adragna | |
| 2006/0048476 | A1 | 3/2006 | Krapf | |
| 2007/0209757 | A1 | 9/2007 | Hengel | |
| 2009/0167070 | A1 | 7/2009 | Chen | |
| 2011/0168077 | A1 | 7/2011 | Bostrom | |
| 2011/0215632 | A1 | 9/2011 | Gleyal | |
| 2011/0278901 | A1 | 11/2011 | Fujita | |
| 2012/0091780 | A1 | 4/2012 | Muller | |
| 2013/0025526 | A1 | 1/2013 | Cooney | |
| 2014/0132050 | A1 * | 5/2014 | Clark | B63B 29/04 297/311 |
| 2017/0225751 | A1 * | 8/2017 | Fuller, IV | B63B 29/04 |

* cited by examiner

MARINE SEAT WITH SAFETY ROLLBACK

INCORPORATION BY REFERENCE

Not applicable.

TECHNICAL FIELD

The present invention is directed to a seat structure and, more particularly, to a composite seat with bolster for marine service.

BACKGROUND

A rollback or bolster is a segment of the seat mounted on hinges and able to pivot from a first position aligned with and forward of the seat to a second position elevated in height above the seat. A marine seat, especially a driver's seat, often is equipped with a bolster so that the driver can see from a higher vantage. This is useful in maneuvering around an obstacle or picking up a line or buoy.

To elevate the seat, the driver will grasp the bolster on either side, raise his weight off the seat, and pivot the bolster upward into the second position. To lower the seat, the driver will again grasp the bolster on either side, raise his weight off the seat, and pivot the bolster downward into the first position. Upon lowering the seat, the driver will allow his weight to drive the seat firmly downward.

The bolster hinge is a four bar linkage having an upper bracket, a lower bracket, and two parallel bars pivotally attached to the brackets. This is shown in FIGS. 15-18. As the hinges pivot from the second position to the first position, the two parallel bars move apart and then move together. In the intermediate positions shown in FIGS. 16 and 17, a significant space opens up between the two parallel bars. One safety problem sometimes encountered with the prior art bolster seats is placement of the hinges at the outer edges of the seat. As the driver grasps the bolster with his fingers underneath, the fingers can slip into the space between the two parallel bars. As the driver's weight impels the bolster downward, the two parallel bars close upon one another, pinching the fingers. The two parallel bars can shear the fingers off. The present invention overcomes this safety hazard, as will be shown hereinbelow.

All vessels operating upon water exhibit six ship motions: Roll is rotation about a fore and aft axis; Pitch is rotation about a transverse axis; Yaw is rotation about a vertical axis; Surge is translation along a fore and aft axis; Sway is translation along a transverse axis; and Heave is translation along a vertical axis. In rough water conditions, a vessel can be thrown about violently in all these directions. Add to these motions the tendency of a planing boat to go airborne over a wave and slam down on the next wave.

Inertial forces generated by the bodyweight of the boat driver are conveyed through the seat to the boat hull. Conversely, forces are transmitted through the seat to the driver. The marine seat must be able to withstand these forces without failure. The seat must also be sufficiently rigid to minimize flexing under inertial forces. Furthermore, the marine seat must be sufficiently resilient to protect the driver from injury due to these forces.

Accordingly, there is a need for a marine seat capable of withstanding inertial forces of ship motion in a seaway.

There is a further need for a marine seat of the type described, and that includes a bolster to provide the driver with a higher vantage viewpoint.

There is a yet further need for a marine seat of the type described, and that will not pinch the driver's fingers causing injury.

There is a still further need for a marine seat of the type described, and that will protect the driver from injury due to inertial forces of a vessel under way.

The present invention is directed toward fulfilling the above-mentioned needs, as well as other needs, and overcoming various disadvantages known in the art.

SUMMARY

In one aspect, a marine seat assembly is used in connection with a boat. The marine seat assembly comprises a hollow tubular frame extending between opposite right and left sides. The frame includes a frame upright portion with a front and a rear. The frame also includes a frame seat portion with a top and a bottom. A plurality of frame panels is disposed on the frame, so as to form at least one composite structure.

A pair of armrests is pivotally mounted on the frame upright portion adjacent the frame upright portion sides. The armrests are mounted for pivotal movement from a first position allowing use to a second position above the first position.

A pair of bolster hinges is mounted on the frame seat portion top adjacent the frame seat portion sides. A bolster having a bolster panel extends between opposite right and left sides. The bolster panel is pivotally mounted on the bolster hinges for pivotal movement from a first position adjacent and in front of the frame seat portion, to a second position adjacent and above the frame seat portion. The bolster hinges are disposed sufficiently inboard of the bolster panel sides so as to preclude insertion of fingers in the bolster hinges, thereby avoiding injury.

In another aspect, a marine seat assembly is used in connection with a boat. The marine seat assembly comprises a hollow tubular metal alloy frame extending between opposite right and left sides. The frame includes a frame upright portion with a front and a rear. The frame also includes a frame seat portion with a top and a bottom.

An upright composite structure includes the frame upright portion with a first polymer resin frame panel mounted directly on the upright portion front. A second polymer resin frame panel is mounted directly on the upright portion rear. The upright composite structure has a greater section modulus than any one of the first frame panel, the second frame panel, and the frame upright portion individually.

A seat composite structure includes the frame seat portion with a third polymer resin frame panel mounted directly on the seat portion top. The seat composite structure has a greater section modulus than either one of the third frame panel and the frame seat portion individually.

The tubular frame has greater stiffness and tensile strength than the frame panels, and the frame panels have greater flexibility and resilience than the tubular frame. Thus, the composite structures will better withstand the forces imposed upon the seat assembly in a marine environment than any one of the frame panels and the tubular frame individually.

A pair of armrests is pivotally mounted on the frame upright portion adjacent the frame upright portion sides. The armrests are mounted for pivotal movement from a first position allowing use to a second position above the first position.

A pair of bolster hinges is mounted on the frame seat portion top adjacent the frame seat portion sides. A bolster having a bolster panel extends between opposite right and left sides. The bolster panel is pivotally mounted on the bolster hinges for pivotal movement from a first position adjacent and in front of the frame seat portion, to a second position adjacent and above the frame seat portion. The bolster hinges are disposed sufficiently inboard of the bolster panel sides so as to preclude insertion of fingers in the bolster hinges, thereby avoiding injury.

In yet another aspect, a marine seat assembly is used in connection with a boat. The marine seat assembly comprises a hollow tubular aluminum alloy frame extending between opposite right and left sides. The frame includes a frame upright portion with a front and a rear. The frame also includes a frame seat portion with a top and a bottom.

An upright composite structure includes the frame upright portion with a first polymer resin frame panel mounted directly on the upright portion front. A second polymer resin frame panel is mounted directly on the upright portion rear. A seat composite structure includes the frame seat portion with a third polymer resin frame panel mounted directly on the seat portion top.

The upright composite structure has a greater section modulus than any one of the first frame panel, the second frame panel, and the frame upright portion individually. The seat composite structure has a greater section modulus than either one of the third frame panel and the frame seat portion individually. The tubular frame has greater stiffness and tensile strength than the frame panels, and the frame panels have greater flexibility and resilience than the tubular frame. Hence, the composite structures will better withstand the forces imposed upon the seat assembly in a marine environment than any one of the frame panels and the tubular frame individually.

A pair of armrests is pivotally mounted on the frame upright portion adjacent the frame upright portion sides. The armrests are mounted for pivotal movement from a first position allowing use to a second position above the first position. The armrests include a pair of aluminum alloy brackets. One bracket is mounted on each side of the frame upright portion. Each bracket has a stud and a limit pin projecting transversely from the bracket. The armrests include an aluminum alloy cantilever member pivotally mounted on the stud for pivotal movement from the first position to the second position. The cantilever member has an arcuate slot adapted to engage the limit pin so as to stop the pivotal movement in the first position and in the second position. The armrests have greater stiffness being mounted on the tubular frame than being mounted on the frame panels.

A pair of bolster hinges is mounted on the frame seat portion top adjacent the frame seat portion sides. A bolster having a bolster panel extends between opposite right and left sides. The bolster panel is pivotally mounted on the bolster hinges for pivotal movement from a first position adjacent and in front of the frame seat portion, to a second position adjacent and above the frame seat portion. The bolster hinges are disposed sufficiently inboard of the bolster panel sides so as to preclude insertion of fingers in the bolster hinges, thereby avoiding injury.

The frame upright portion includes two generally vertical tubes disposed at the frame upright portion right and left sides. Each vertical tube is attached to the frame seat portion at a proximal end and extends upward to a distal end. The frame seat portion includes two generally horizontal tubes disposed at the frame seat portion right and left sides. Each horizontal tube is attached to the frame upright portion at a proximal end and extends forward to a distal end. A plurality of transverse tubes extends between the vertical tubes and the horizontal tubes.

The transverse tubes are attached to the vertical tubes and to the horizontal tubes by a plurality of connectors received the ends of the transverse tubes. A plurality of first fasteners attach the connectors to the transverse tubes. A plurality of second fasteners attach the connectors to the vertical tubes and to the horizontal tubes.

The frame upright portion is joined to the frame seat portion. A plurality of gussets attach the vertical tubes proximal ends to the horizontal tubes proximal ends. A plurality of third fasteners attach the gussets to the vertical and horizontal tubes.

In addition to the fasteners, a structural adhesive attaches the connectors to the transverse tubes, the vertical tubes, and the horizontal tubes. The structural adhesive attaches the gussets to the vertical tubes and to the horizontal tubes.

The structural adhesive also attaches the resin frame panels to the metal alloy frame, so as to distribute forces over a larger area than with the fasteners alone. This reduces stress on the upright composite structure and on the seat composite structure where the frame panels attach to the metal alloy frame. The fastener and structural adhesive combination also reduces stress where the connectors and gussets attach to the metal alloy frame. The structural adhesive combined with the fasteners is stronger than either one of the structural adhesive and the fasteners individually.

These and other aspects, objectives, features, and advantages of the disclosed technologies will become apparent from the following detailed description of illustrative embodiments thereof, which is to be read in connection with the accompanying drawings.

DETAILED DESCRIPTION

Figure 1:
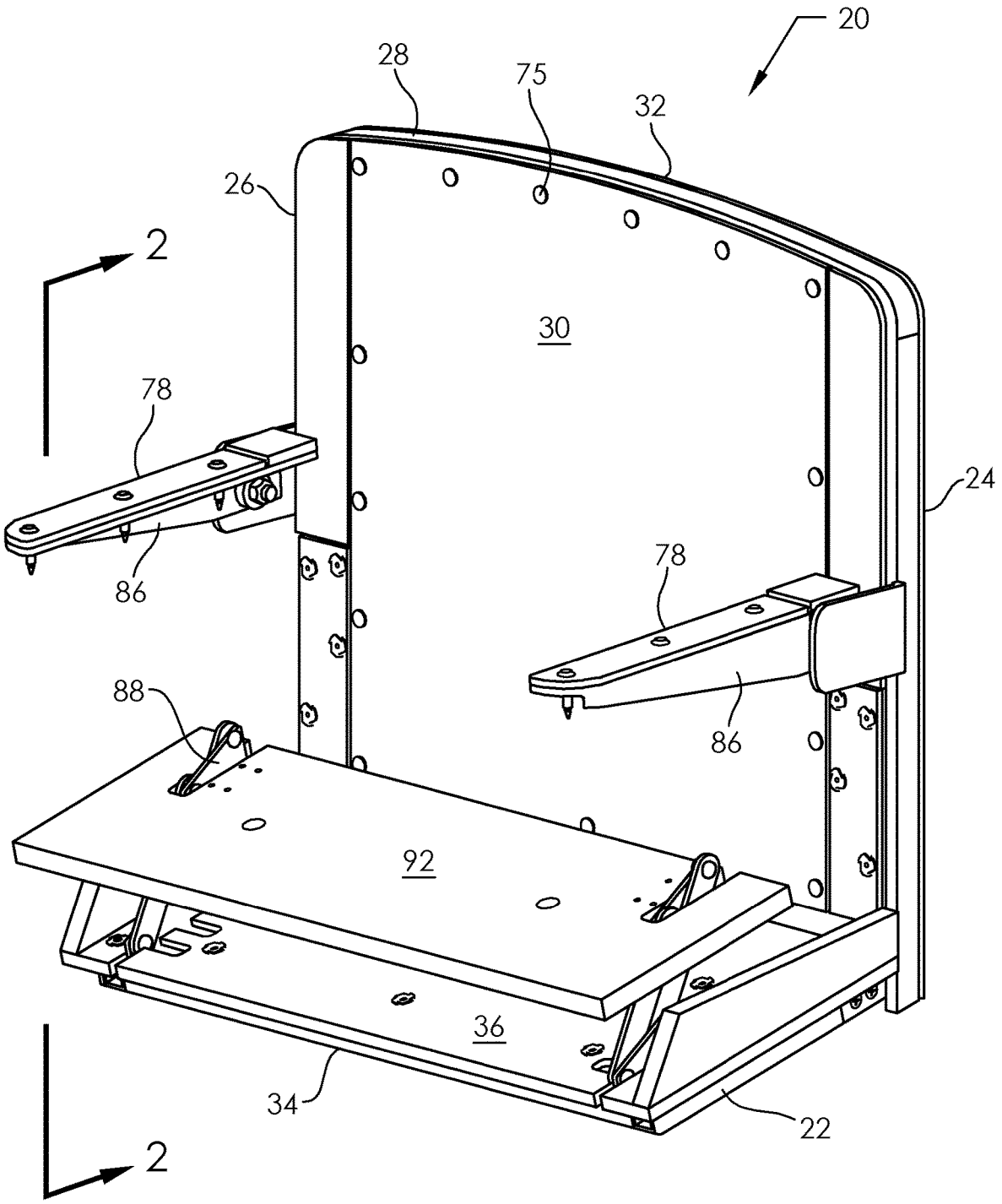
FIG. 1 is an isometric assembly view of an exemplary marine seat constructed in accordance with the invention, and without showing upholstery.

Describing now in further detail these exemplary embodiments with reference to the Figures as described above, a marine seat assembly 20 is for use in connection with a boat (not shown). The marine seat assembly 20 comprises a hollow tubular frame 22, typically made from a metal alloy forming a hollow tubular metal alloy frame 22, preferably a hollow tubular aluminum alloy frame 22, extending between opposite right 24 and left 26 sides. As used herein, the right 24 and left 26 sides are defined from a viewpoint in front of the seat looking aft. The frame 22 includes a frame upright portion 28 with a front 30 and a rear 32. The frame 22 includes a frame seat portion 34 with a top 36 and a bottom 38.

The frame upright portion 28 includes two generally vertical tubes 40 disposed at the frame upright portion right 24 and left 26 sides. Each vertical tube 40 is attached to the frame seat portion 34 at a proximal end 42 and extends upward to a distal end 44. A plurality of transverse tubes 52 having right 54 and left 56 opposite ends extend between the vertical tubes from the right side 24 to the left side 26. The vertical tubes 40 are typically angled back slightly for seating comfort.

The frame seat portion 34 includes two generally horizontal tubes 46 disposed at the frame seat portion right 24 and left 26 sides. Each horizontal tube 46 is attached to the frame upright portion 28 at a proximal end 48 and extends forward to a distal end 50. A plurality of transverse tubes 52 having right 54 and left 56 opposite ends extend between the horizontal tubes from the right side 24 to the left side 26. The horizontal tubes 46 can also be angled with respect to the vessel base line for seating comfort.

The transverse tubes 52 are attached to the vertical tubes 40 and to the horizontal tubes 46 by a plurality of connectors 58. One connector 58 is received in each end 54, 56 of each one of the transverse tubes 52. A plurality of first fasteners 60, typically two, attach the connector 58 to the transverse tube 52. The first fasteners 60 are preferably pins pressed into holes formed in the tube and the connector. A plurality of second fasteners 62, typically two, attach each connector 58 to the vertical tubes 40 and to the horizontal tubes 46. The second fasteners 62 are preferably screws threaded into tapped holes in the connector. Alternatively, rivets could be used.

The frame upright portion 28 is joined to the frame seat portion 34. A plurality of gussets 64 attach the vertical tubes proximal ends 42 to the horizontal tubes proximal ends 48. Four gussets 64 are needed, with two gussets 64 at each vertical to horizontal tube joint. One gusset 64 is on the outside and one on the inside of each joint. A plurality of third fasteners 66 attach the gussets 64 to the vertical tubes 40 and to the horizontal tubes 46. The third fasteners 66 are preferably bolts with mating nuts.

In addition to the fasteners, a structural adhesive is used to attach the connectors 58 to the transverse tubes 52, the vertical tubes 40, and the horizontal tubes 46. The structural adhesive is also used to attach the gussets 64 to the vertical tubes 40 and to the horizontal tubes 46. Advantageously, the structural adhesive combined with the fasteners 60, 62, 66, is stronger than either one of the adhesive and the fasteners individually. The redundant attachment allows the joints to withstand the stresses imposed by the harsh marine environment.

The vertical tubes 40, the horizontal tubes 46, and the transverse tubes 52 typically comprise a metal alloy. The preferred embodiment material is aluminum alloy. Steel alloy can be employed as well. Further optional materials include fiber reinforced polymer resins, such as thermoplastic resins and thermoset resins. The fiber can be any structural filament material, for example, fiberglass, Kevlar®, and carbon graphite fiber.

The marine seat assembly 20 includes a plurality of frame panels disposed on the frame 22, forming at least one composite structure. An upright composite structure 68 comprises the frame upright portion 28 with a first frame panel 70, typically a first polymer resin frame panel 70, mounted directly on the upright portion front 30, and a second frame panel 72, typically a second polymer resin frame panel 72, mounted directly on the upright portion rear 32. The upright composite structure 68 has a greater section modulus as an assembly, than any one of the first frame panel 70, or the second frame panel 72, or the frame upright portion 28, taken individually.

The upright composite structure 68 includes a plurality of fourth fasteners 75 attaching the first polymer resin frame panel 70 to the upright portion front 30. The fourth fasteners 75 attach the second polymer resin frame panel 72 to the upright portion rear 32. In addition to the fourth fasteners 75, the structural adhesive attaches the first polymer resin frame panel 70 to the upright portion front 30. The structural adhesive attaches the second polymer resin frame panel 72 to the upright portion rear 32.

A seat composite structure 74 comprises the frame seat portion 34 with a third frame panel 76, typically a third polymer resin frame panel 76, mounted directly on the seat portion top 36. The seat composite structure 74 has a greater section modulus than either one of the third frame panel 76 or the frame seat portion 34, taken individually.

The seat composite structure 74 includes the fourth fasteners 75 attaching the third polymer resin frame panel 76 to the seat portion top 36. In concert with the fasteners, the structural adhesive also attaches the third polymer resin frame panel 76 to the seat portion top 36. The advantage is that the structural adhesive combined with the fasteners is stronger than either one of the structural adhesive or the fasteners individually.

The use of fasteners alone, as in the prior art, presents further problems. Each fastener is inserted through a hole in the panel and a hole in the frame. The forces transmitted through each connection are concentrated around the hole, resulting in a stress riser, or concentration of stress adjacent the hole. The hole further comprises a weak region adjacent the panel edge. Polymer resins typically are relatively strong in tension and relatively weak in shear strength. Hence, the concentrated stresses can induce shear failure of the panel outward to the edge.

A further advantage of attaching the resin frame panels to the metal alloy frame with structural adhesive is to distribute the forces over a larger area, thereby reducing the stress.

$$\tau = \frac{F}{A}$$

Where: τ=shear stress; F=force; A=area

In addition, the holes are surrounded by adhesive, thus eliminating stress risers. The problem of prior-art panels tearing out is solved by the present invention. The fasteners serve to align the parts of the assembly, clamp the parts together while the adhesive sets, and increase the strength of the seat composite structure 74.

The tubular frame 22 has greater stiffness and tensile strength than the frame panels 70, 72, and 76, and the frame panels have greater flexibility and resilience than the tubular frame, so that the composite structures 68 and 74, as assembled, will better withstand the forces imposed upon the seat assembly 20 in a marine environment than any one of the frame panels or the tubular frame taken individually.

Figure 4:
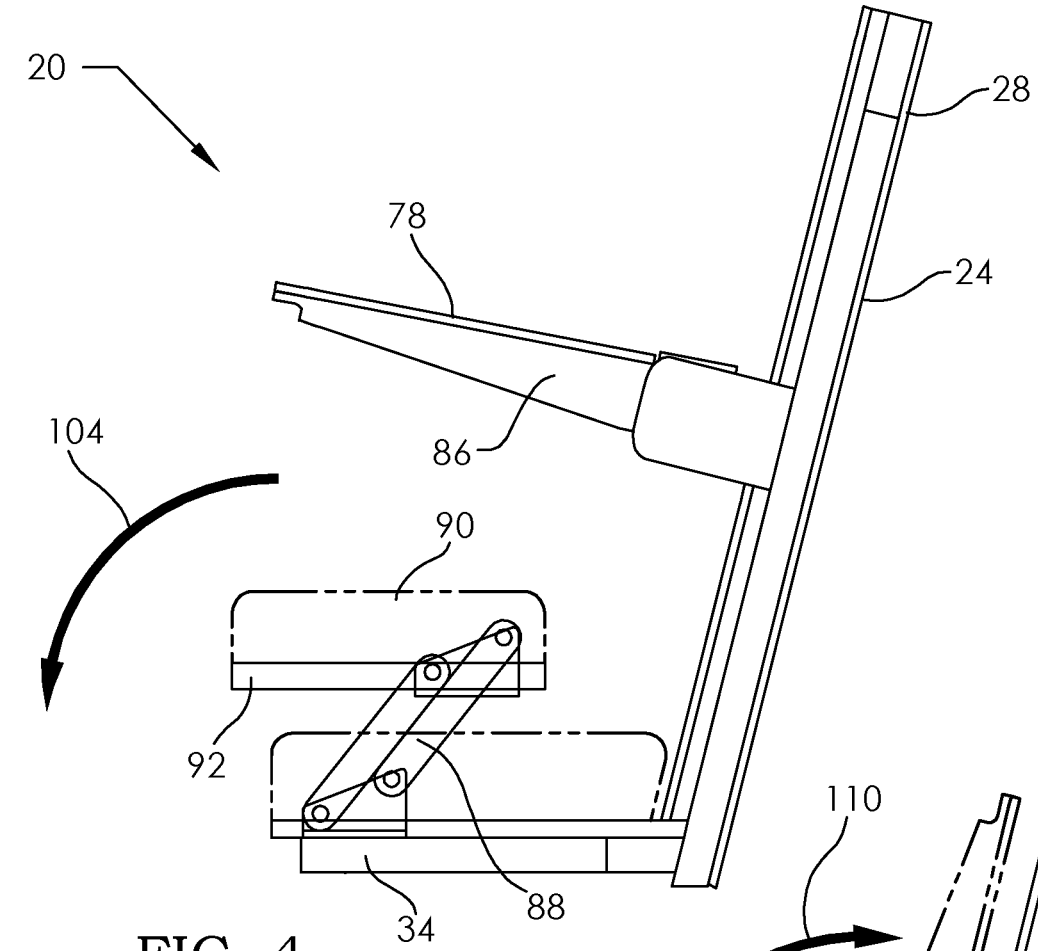
FIG. 4 is a right side elevational view of the marine seat of FIG. 1, showing the bolster in the second position, and showing upholstery in phantom, and showing the armrest in the first position.
Figure 5:
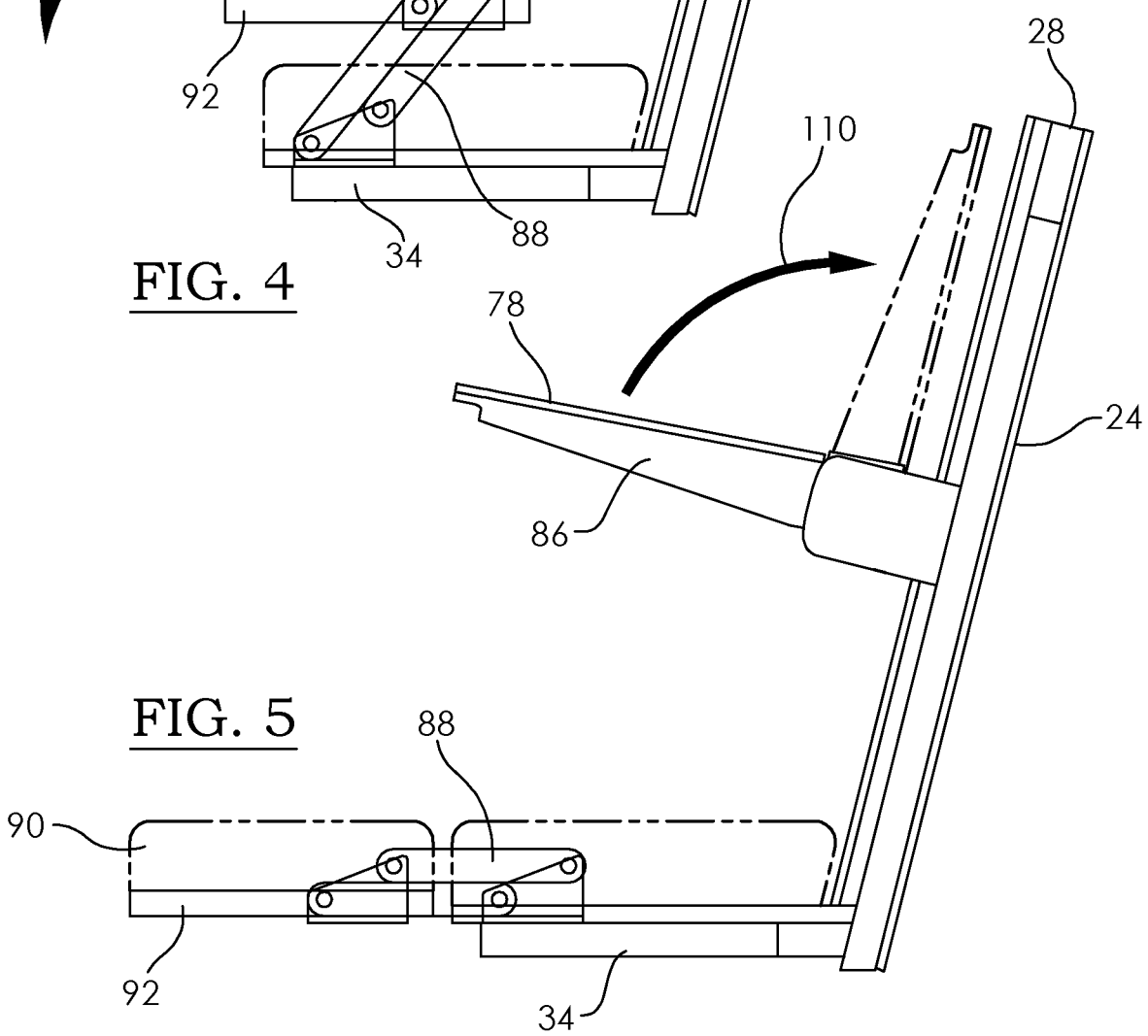
FIG. 5 is a right side elevational view of the marine seat of FIG. 1, showing the bolster in the first position, and showing upholstery in phantom, and showing the armrest in the second position in phantom.
Figure 6:
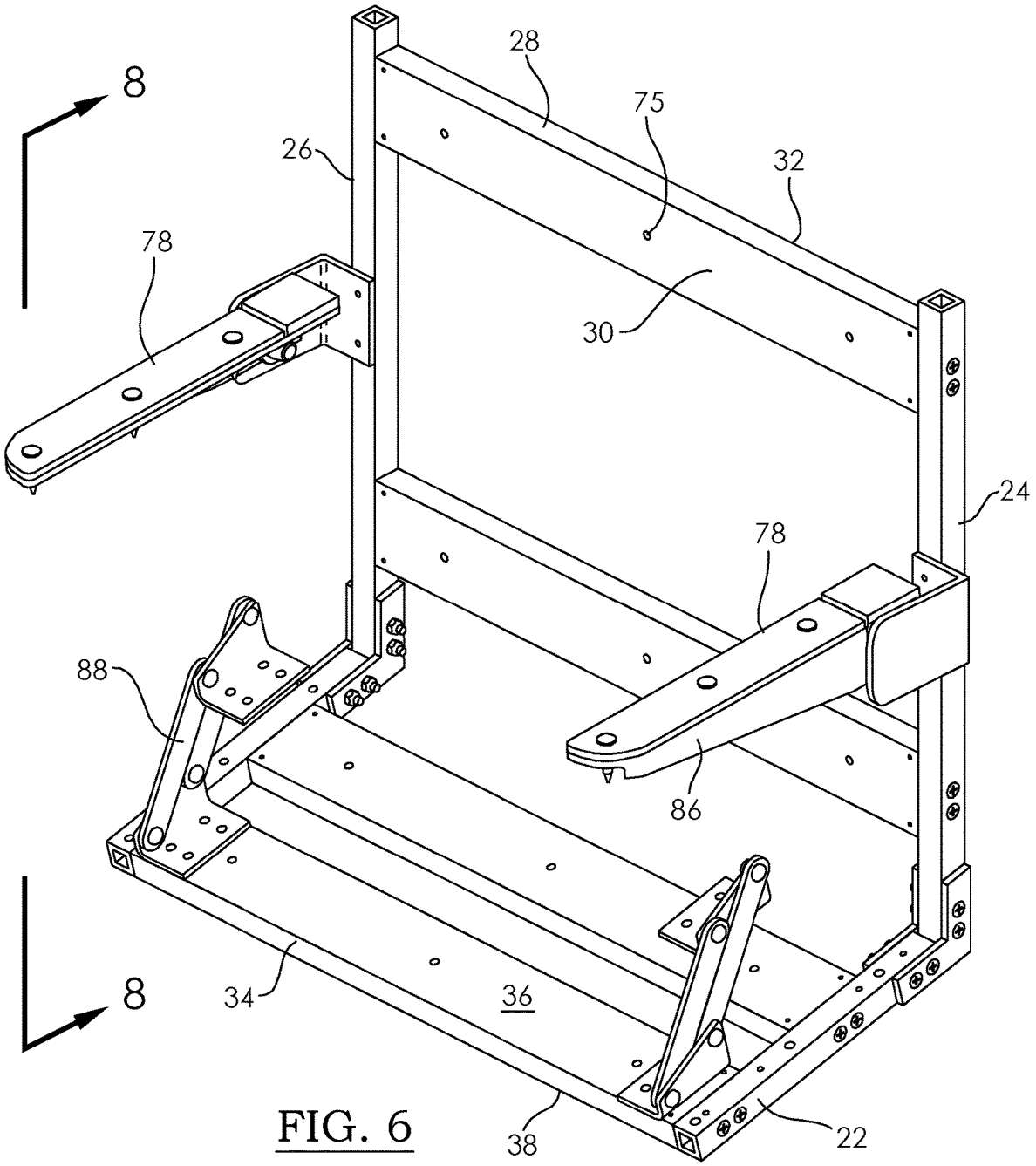
FIG. 6 is an isometric assembly view of the marine seat of FIG. 1, showing the frame and without the polymer panels.
Figure 7:
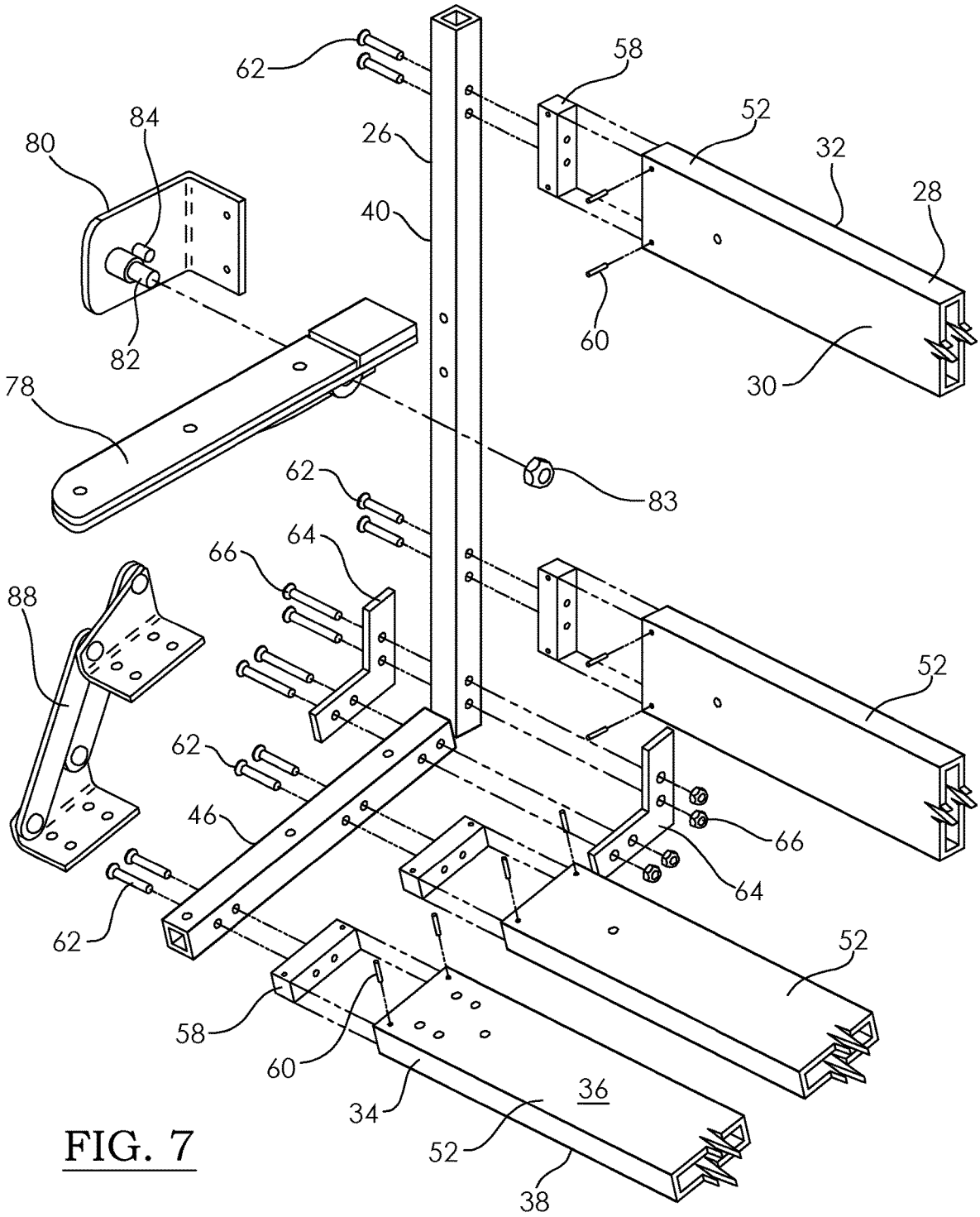
FIG. 7 an exploded isometric assembly view of the frame of the marine seat of FIG. 1, showing half the frame and without the polymer panels.
Figure 10:
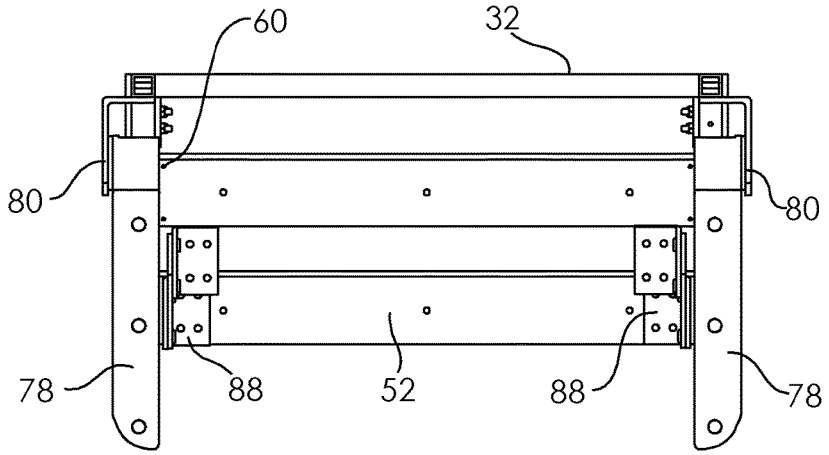
FIG. 10 is a top plan view of FIG. 8.
Figure 9:
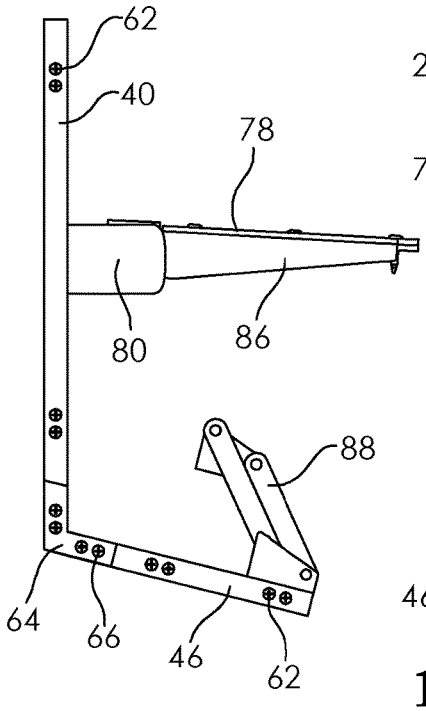
FIG. 9 is a left side elevational view of FIG. 8.
Figure 8:
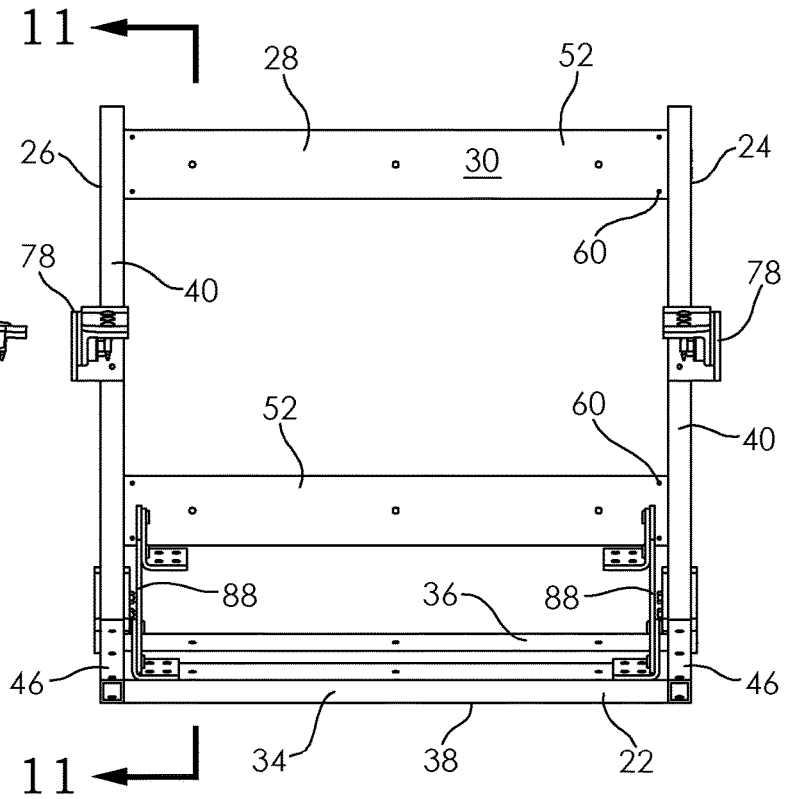
FIG. 8 is a front elevational view of the frame of the marine seat of FIG. 1, taken along view lines 8-8 of FIG. 6.
Figure 12:
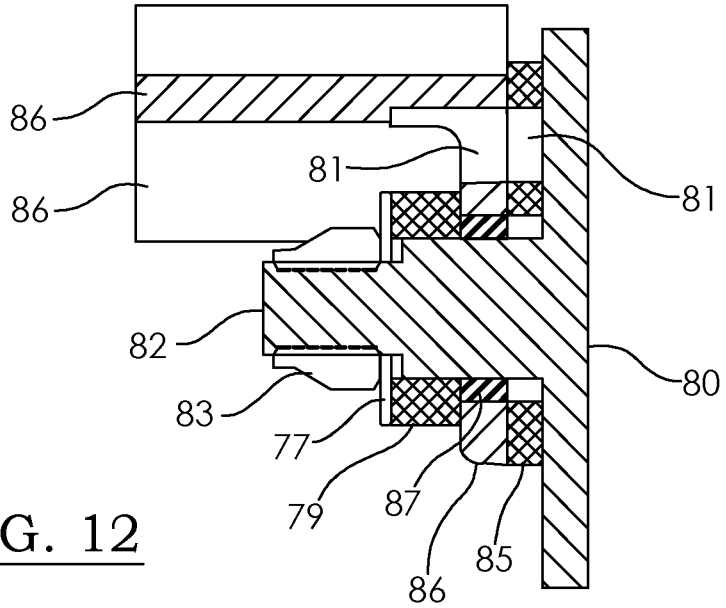
FIG. 12 is an enlarged, cross-sectional detail view of the armrest mount of the marine seat of FIG. 1, taken along lines 12-12 of FIG. 11.
Figure 11:
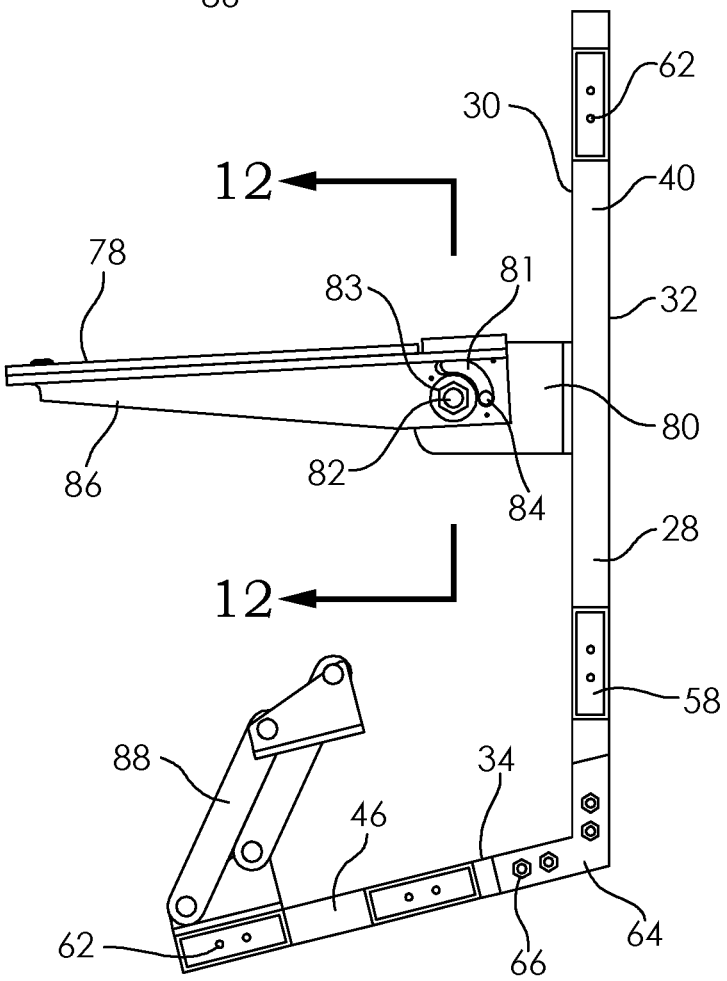
FIG. 11 is a left side sectional elevational view of FIG. 8, taken along lines 11-11 of FIG. 8.
Figure 13:
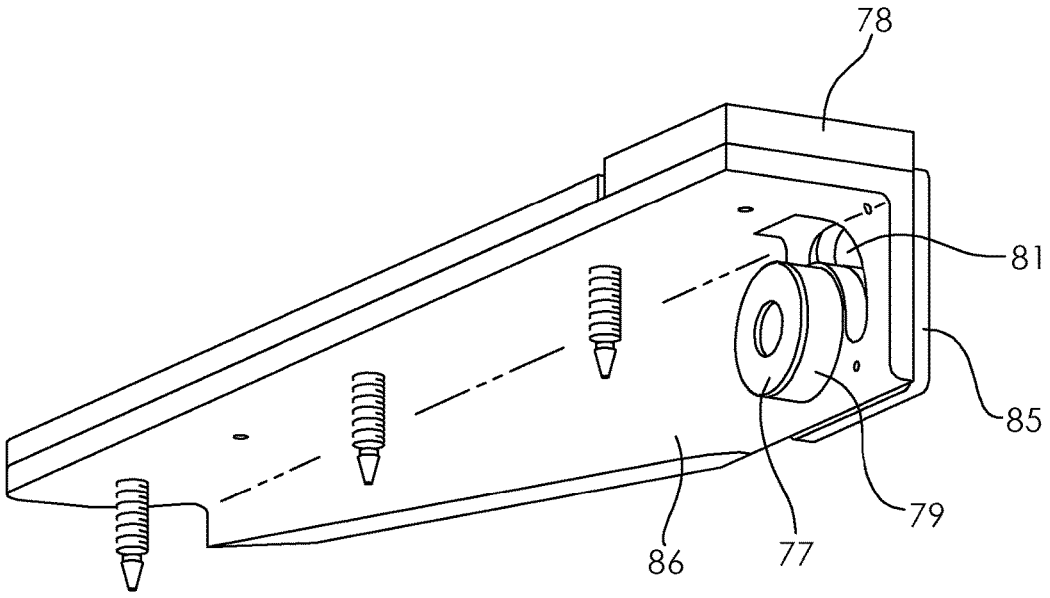
FIG. 13 is a perspective view of the armrest of the marine seat of FIG. 1.
Figure 14:
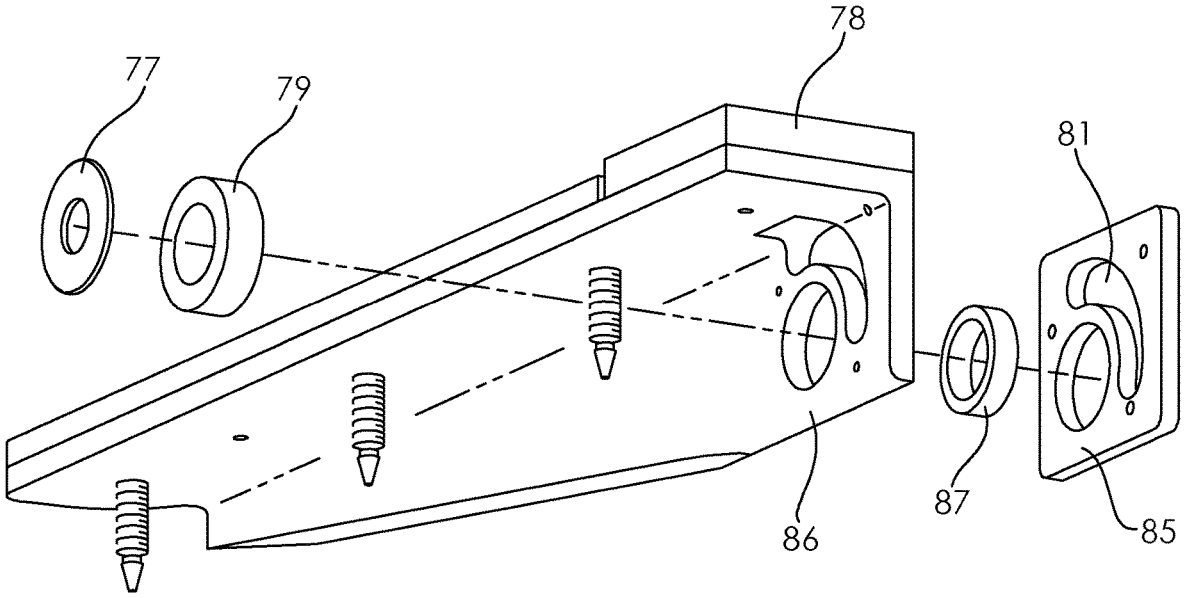
FIG. 14 is an exploded assembly perspective view of the armrest of the marine seat of FIG. 1.

A pair of armrests 78 are mounted on the frame upright portion 28 adjacent the frame upright portion sides 24 and 26. The armrests 78 are mounted on the frame vertical tubes 40 for strength and stiffness. The armrests 78 are pivotally mounted for pivotal movement from a first position allowing use, to a second position above the first position. The first position is shown in FIG. 4, and the second position is shown in FIG. 5, in phantom lines. Arrow 110 indicates armrest pivotal movement from the first position to the second position.

The armrests 78 include a pair of aluminum alloy brackets 80. One bracket is mounted on each side of the frame upright portion 28. Each bracket 80 has a stud 82 and a limit pin 84 projecting transversely therefrom. Each armrest 78 includes an aluminum alloy cantilever member 86 pivotally mounted on the stud 82 for pivotal movement from the first position to the second position. The cantilever member 86 has an arcuate slot 81 adapted to engage the limit pin 84 so as to stop the pivotal movement in the first position and in the second position. The armrests 78 have greater stiffness being mounted on the tubular frame 22 than being mounted on the frame panels 70 and 72. An anti-friction plate 85 is disposed between the cantilever member 86 and the bracket 80. An anti-friction bushing 87 is disposed between the cantilever member 86 and the stud 82. A stud fastener 83, such as a nut, is adapted to engage the stud 82 to retain the cantilever member 86 on the stud 82. An anti-friction spacer 79 and a washer 77 are disposed between the cantilever member 86 and the stud fastener 83.

A pair of bolster hinges 88 are mounted on the frame seat portion top 36 adjacent the frame seat portion sides 24 and 26. A bolster 90 is mounted on the seat assembly 20. The bolster 90 has a bolster panel 92 extending between opposite right 94 and left 96 sides and pivotally mounted on the bolster hinges 88. The bolster panel 92 is mounted for pivotal movement from a first position adjacent and in front of the frame seat portion 34, to a second position adjacent and above the frame seat portion 34. The bolster 90 is shown in FIG. 5 in the first position. The phantom lines represent upholstery. The second position is shown in FIG. 4. Arrow 104 indicates bolster pivotal movement from the second position toward the first position.

The bolster hinge 88 is a four bar linkage having an upper bracket 98, a lower bracket 100, and two parallel bars 102 pivotally attached to the brackets. This is shown in FIGS. 15-18. As the hinges 88 pivot from the second position to the first position, the two parallel bars 102 move apart and then move together. In the intermediate positions shown in FIGS. 16 and 17, a significant space 108 opens up between the two parallel bars 102. The space 108 presents a significant safety hazard for fingers, as described above.

Figure 2:
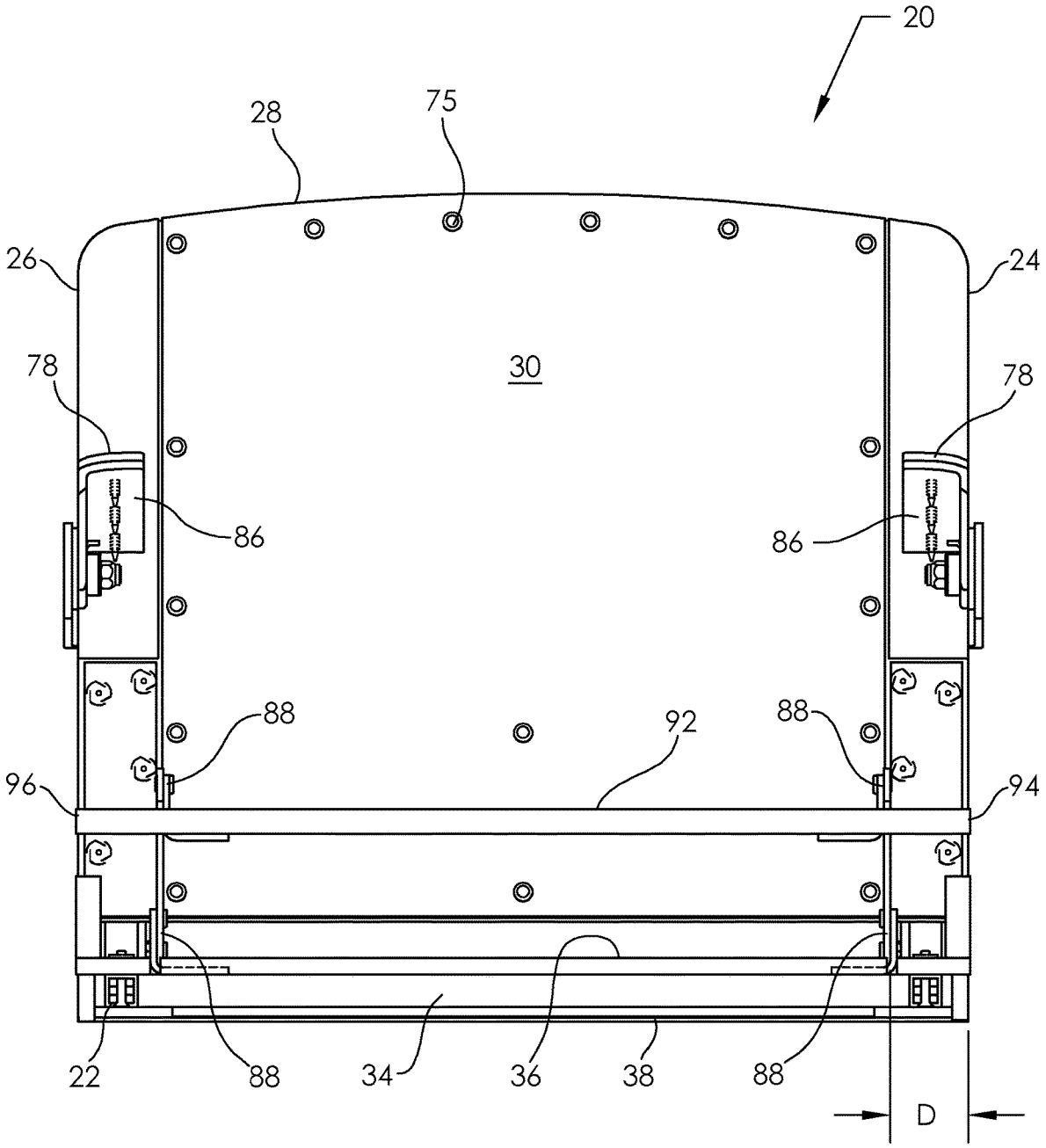
FIG. 2 is a front elevational view of the marine seat of FIG. 1.
Figure 3:
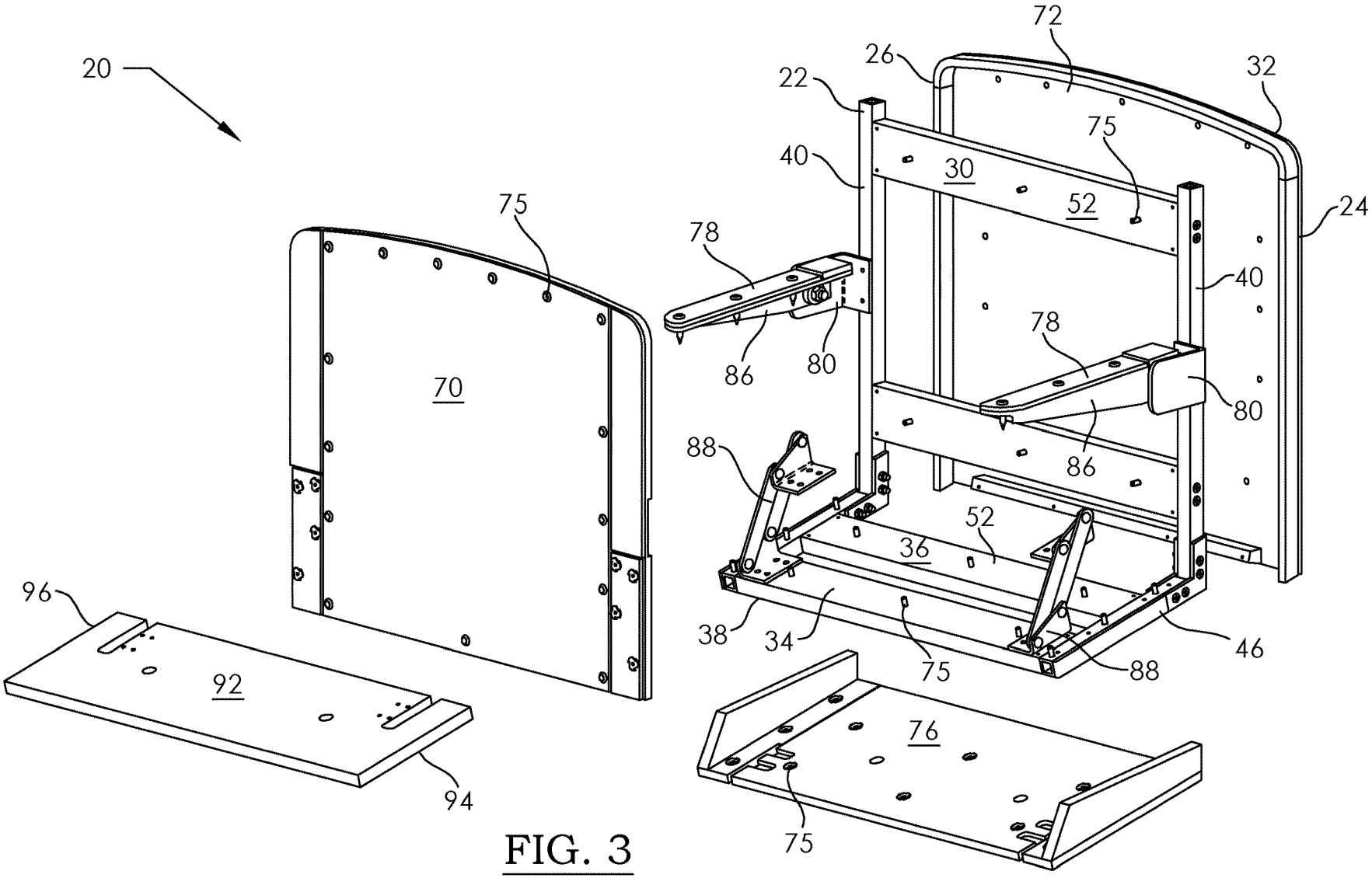
FIG. 3 is an exploded isometric assembly view of the marine seat of FIG. 1.
Figure 16:
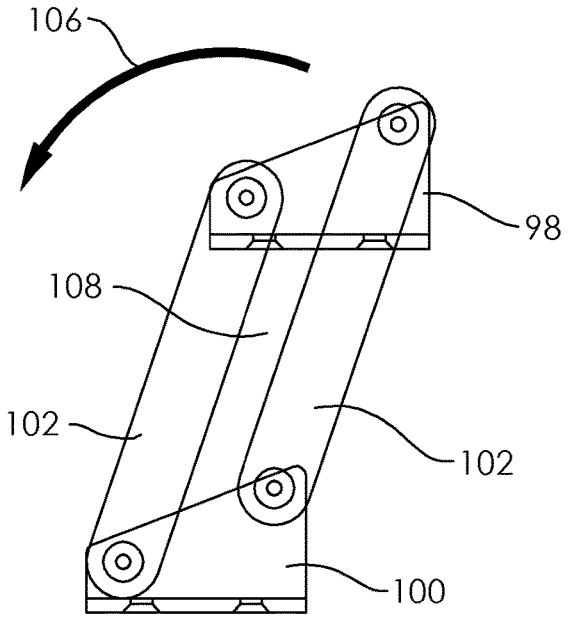
FIG. 16 is a right side elevational view of the bolster hinge of FIG. 15, showing the hinge in an intermediate position.
Figure 15:
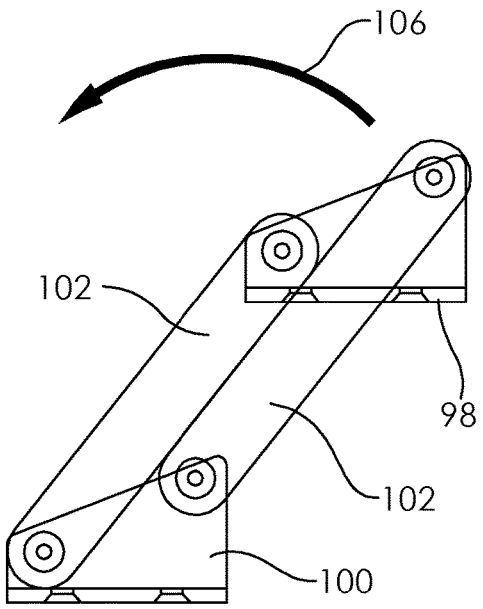
FIG. 15 is a right side elevational view of a bolster hinge of the marine seat of FIG. 1, showing the hinge in the second position.
Figure 17:
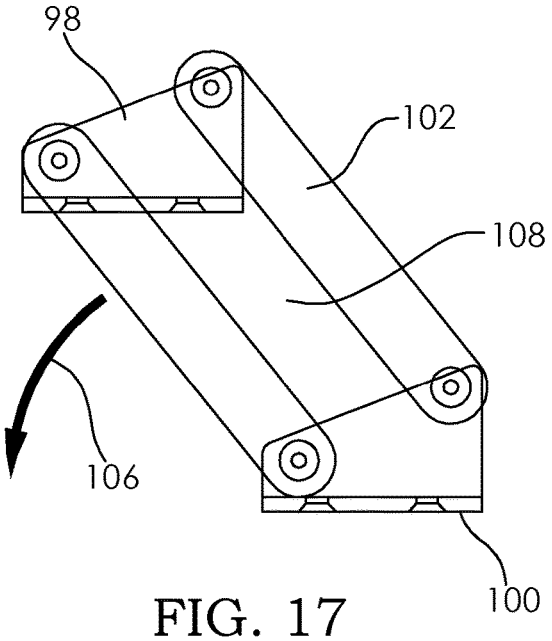
FIG. 17 is a right side elevational view of the bolster hinge of FIG. 15, showing the hinge in another intermediate position.
Figure 18:
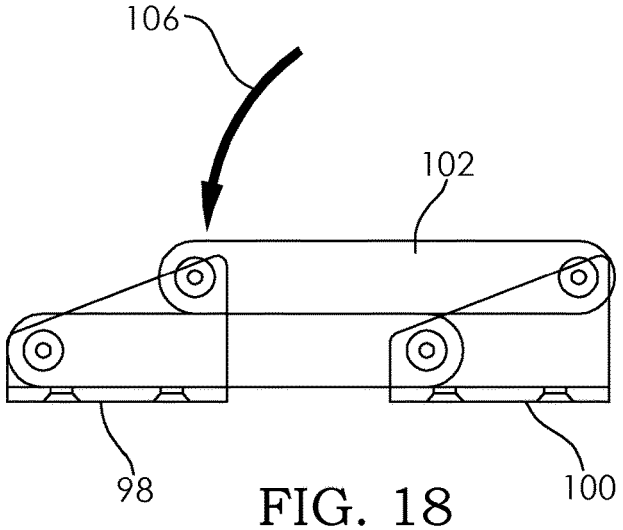
FIG. 18 is a right side elevational view of a bolster hinge of FIG. 15, showing the hinge in the first position.

A novel safety feature is the mounting position of the bolster hinges 88. As shown in FIG. 2, the bolster hinges 88 are mounted inboard of the bolster panel sides by distance D. As the driver reaches around to grasp the edge of the bolster to raise or lower it, the distance D places the hinges beyond the reach of fingers. The bolster hinges 88 are thus disposed sufficiently inboard of the bolster panel sides 94 and 96, so as to preclude insertion of fingers in the bolster hinges, thereby avoiding injury. FIG. 15 shows the bolster hinge 88 in the second position. FIG. 16 shows the bolster hinge 88 moving forward from the second position. FIG. 17 shows the bolster hinge 88 moving downward toward the first position. FIG. 18 shows the bolster hinge 88 in the first position. Arrows 106 indicate bolster hinge pivotal movement from the second position toward the first position.

The frame panels 70, 72, and 76, and the bolster panel 92, are typically made from a polymer resin, such as a thermoplastic resin or a thermoset resin. The panels can be reinforced with a fiber material, which could be, for example, fiberglass, Kevlar®, or carbon graphite fiber. Alternatively, any structural material formed into a panel can be employed, such as plywood.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A marine seat assembly, for use in connection with a boat, the marine seat assembly comprising:

a hollow tubular frame extending between opposite right and left sides, the frame including a frame upright portion with a front and a rear, and a frame seat portion with a top and a bottom;

a pair of bolster hinges mounted on the frame seat portion top adjacent the frame seat portion sides;

a plurality of frame panels disposed on the frame, so as to form at least one composite structure;

a pair of armrests pivotally mounted on the frame upright portion adjacent the frame upright portion sides, for pivotal movement from a first position allowing use to a second position above the first position; and a bolster having a bolster panel extending between opposite right and left sides and pivotally mounted on the bolster hinges for pivotal movement from a first position adjacent and in front of the frame seat portion, to a second position adjacent and above the frame seat portion; wherein the bolster hinges are disposed sufficiently inboard of the bolster panel sides so as to preclude insertion of fingers in the bolster hinges, thereby avoiding injury.

2. The marine seat assembly of claim 1, further comprising:

a first frame panel mounted directly on the upright portion front; and a second frame panel mounted directly on the upright portion rear, forming an upright composite structure of the first frame panel, the second frame panel, and the frame upright portion; wherein the upright composite structure has a greater section modulus than any one of the first frame panel, the second frame panel, and the frame upright portion individually.

3. The marine seat assembly of claim 2, further comprising:

a third frame panel mounted directly on the seat portion top, forming a seat composite structure of the third frame panel and the frame seat portion; wherein the seat composite structure has a greater section modulus than either one of the third frame panel and the frame seat portion individually.

4. The marine seat assembly of claim 3, wherein:

the tubular frame further comprises a metal alloy having greater stiffness and tensile strength than the frame panels; and the frame panels further comprise a polymer resin having greater flexibility and resilience than the tubular frame; so that the composite structures will better withstand the forces imposed upon the seat assembly in a marine environment than any one of the frame panels and the frame individually.

5. The marine seat assembly of claim 1, wherein the frame further comprises:

two generally vertical tubes disposed at the frame upright portion right and left sides, each vertical tube being attached to the frame seat portion at a proximal end and extending upward to a distal end;

two generally horizontal tubes disposed at the frame seat portion right and left sides, each horizontal tube being attached to the frame upright portion at a proximal end and extending forward to a distal end;

a plurality of gussets attaching the vertical tubes proximal ends to the horizontal tubes proximal ends;

a plurality of transverse tubes having opposite ends and extending between the vertical tubes and the horizontal tubes;

a plurality of connectors, one connector being received in each end of the transverse tubes;

a plurality of first fasteners attaching the connectors to the transverse tubes;

a plurality of second fasteners attaching the connectors to the vertical tubes and to the horizontal tubes; and a plurality of third fasteners attaching the gussets to the vertical tubes and to the horizontal tubes.

6. The marine seat assembly of claim 5, wherein the vertical tubes, the horizontal tubes, and the transverse tubes further comprise a metal alloy selected from the group consisting of:

aluminum alloy; and steel alloy.

7. The marine seat assembly of claim 5, wherein the vertical tubes, the horizontal tubes, and the transverse tubes further comprise a fiber reinforced polymer resin, wherein:

the resin is selected from the group consisting of:

a thermoplastic resin; and a thermoset resin; and the fiber is selected from the group consisting of:

fiberglass;

Kevlar; and carbon fiber.

8. The marine seat assembly of claim 5, further comprising a structural adhesive, wherein:

the structural adhesive attaches the connectors to the transverse tubes, the vertical tubes, and the horizontal tubes;

the structural adhesive attaches the gussets to the vertical tubes and to the horizontal tubes;

the structural adhesive attaches the resin frame panels to the metal alloy frame, so as to distribute forces over a larger area than with the fasteners alone, thereby reducing stress on the upright composite structure and the seat composite structure where the frame panels attach to the metal alloy frame; and wherein the structural adhesive combined with the fasteners is stronger than either one of the structural adhesive and the fasteners individually.

9. The marine seat assembly of claim 1, wherein the frame panels and the bolster panel further comprise a polymer resin selected from the group consisting of:

a thermoplastic resin; and a thermoset resin.

10. The marine seat assembly of claim 9, wherein the frame panels and the bolster panel further comprise a reinforcing fiber selected from the group consisting of:

fiberglass;

Kevlar; and carbon graphite fiber.

11. The marine seat assembly of claim 1, wherein the armrests further comprise:

a pair of brackets, one bracket being mounted on each vertical tube, each bracket having a stud and a limit pin projecting transversely therefrom; and a cantilever member pivotally mounted on the stud for pivotal movement from the first position to the second position, the cantilever member having an arcuate slot adapted to engage the limit pin so as to stop the pivotal movement in the first position and in the second position.

12. The marine seat assembly of claim 11, wherein the armrests further comprise:

an anti-friction plate disposed between the cantilever member and the bracket;

an anti-friction bushing disposed between the cantilever member and the stud; and a stud fastener adapted to engage the stud to retain the cantilever member on the stud.

13. A marine seat assembly, for use in connection with a boat, the marine seat assembly comprising:

a hollow tubular metal alloy frame extending between opposite right and left sides, the frame including a frame upright portion with a front and a rear, and a frame seat portion with a top and a bottom;

an upright composite structure comprising:

the frame upright portion;

a first polymer resin frame panel mounted directly on the upright portion front; and a second polymer resin frame panel mounted directly on the upright portion rear;

a seat composite structure comprising:

the frame seat portion; and a third polymer resin frame panel mounted directly on the seat portion top;

a pair of armrests pivotally mounted on the frame upright portion adjacent the frame upright portion sides, for pivotal movement from a first position allowing use to a second position above the first position;

a pair of bolster hinges mounted on the frame seat portion top adjacent the frame seat portion sides; and a bolster having a bolster panel extending between opposite right and left sides and pivotally mounted on the bolster hinges for pivotal movement from a first position adjacent and in front of the frame seat portion, to a second position adjacent and above the frame seat portion; wherein the bolster hinges are disposed sufficiently inboard of the bolster panel sides so as to preclude insertion of fingers in the bolster hinges, thereby avoiding injury;

the upright composite structure has a greater section modulus than any one of the first frame panel, the second frame panel, and the frame upright portion individually;

the seat composite structure has a greater section modulus than either one of the third frame panel and the frame seat portion individually; and the tubular frame has greater stiffness and tensile strength than the frame panels, and the frame panels have greater flexibility and resilience than the tubular frame, so that the composite structures will better withstand the forces imposed upon the seat assembly in a marine environment than any one of the frame panels and the tubular frame individually.

14. The marine seat assembly of claim 13, wherein the frame further comprises:

two generally vertical tubes disposed at the frame upright portion right and left sides, each vertical tube being attached to the frame seat portion at a proximal end and extending upward to a distal end;

two generally horizontal tubes disposed at the frame seat portion right and left sides, each horizontal tube being attached to the frame upright portion at a proximal end and extending forward to a distal end;

a plurality of gussets attaching the vertical tubes proximal ends to the horizontal tubes proximal ends;

a plurality of transverse tubes having opposite ends and extending between the vertical tubes and the horizontal tubes;

a plurality of connectors, one connector being received in each end of the transverse tubes;

a plurality of first fasteners attaching the connectors to the transverse tubes;

a plurality of second fasteners attaching the connectors to the vertical tubes and to the horizontal tubes; and a plurality of third fasteners attaching the gussets to the vertical tubes and to the horizontal tubes.

15. The marine seat assembly of claim 14, wherein the vertical tubes, the horizontal tubes, and the transverse tubes further comprise a metal alloy selected from the group consisting of:

aluminum alloy; and steel alloy.

16. The marine seat assembly of claim 13, wherein the frame panels and the bolster panel further comprise a reinforcing fiber selected from the group consisting of:

fiberglass;

Kevlar; and carbon graphite fiber.

17. The marine seat assembly of claim 14, further comprising a structural adhesive, wherein:

the structural adhesive attaches the connectors to the transverse tubes, the vertical tubes, and the horizontal tubes;

the structural adhesive attaches the gussets to the vertical tubes and to the horizontal tubes;

the structural adhesive attaches the resin frame panels to the metal alloy frame, so as to distribute forces over a larger area than with the fasteners alone, thereby reducing stress on the upright composite structure and the seat composite structure where the frame panels attach to the metal alloy frame; and wherein the structural adhesive combined with the fasteners is stronger than either one of the adhesive and the fasteners individually.

18. A marine seat assembly, for use in connection with a boat, the marine seat assembly comprising:

a hollow tubular aluminum alloy frame extending between opposite right and left sides, the frame including a frame upright portion with a front and a rear, and a frame seat portion with a top and a bottom;

an upright composite structure comprising:

the frame upright portion;

a first polymer resin frame panel mounted directly on the upright portion front; and a second polymer resin frame panel mounted directly on the upright portion rear;

a seat composite structure comprising:

the frame seat portion; and a third polymer resin frame panel mounted directly on the seat portion top;

a pair of armrests pivotally mounted on the frame upright portion adjacent the frame upright portion sides, for pivotal movement from a first position allowing use to a second position above the first position, the armrests including a pair of aluminum alloy brackets, one bracket being mounted on each side of the frame upright portion, each bracket having a stud and a limit pin projecting transversely from the bracket, the armrests including an aluminum alloy cantilever member pivotally mounted on the stud for pivotal movement from the first position to the second position, the cantilever member having an arcuate slot adapted to engage the limit pin so as to stop the pivotal movement in the first position and in the second position;

a pair of bolster hinges mounted on the frame seat portion top adjacent the frame seat portion sides; and a bolster having a bolster panel extending between opposite right and left sides and pivotally mounted on the bolster hinges for pivotal movement from a first position adjacent and in front of the frame seat portion, to a second position adjacent and above the frame seat portion; wherein the bolster hinges are disposed sufficiently inboard of the bolster panel sides so as to preclude insertion of fingers in the bolster hinges, thereby avoiding injury;

the upright composite structure has a greater section modulus than any one of the first frame panel, the second frame panel, and the frame upright portion individually;

the seat composite structure has a greater section modulus than either one of the third frame panel and the frame seat portion individually;

the tubular frame has greater stiffness and tensile strength than the frame panels, and the frame panels have greater flexibility and resilience than the tubular frame, so that the composite structures will better withstand the forces imposed upon the seat assembly in a marine environment than any one of the frame panels and the tubular frame individually; and the armrests have greater stiffness being mounted on the tubular frame than being mounted on the frame panels.

19. The marine seat assembly of claim 18, wherein the frame further comprises:

two generally vertical tubes disposed at the frame upright portion right and left sides, each vertical tube being attached to the frame seat portion at a proximal end and extending upward to a distal end;

two generally horizontal tubes disposed at the frame seat portion right and left sides, each horizontal tube being attached to the frame upright portion at a proximal end and extending forward to a distal end;

a plurality of gussets attaching the vertical tubes proximal ends to the horizontal tubes proximal ends;

a plurality of transverse tubes having opposite ends and extending between the vertical tubes and the horizontal tubes;

a plurality of connectors, one connector being received in each end of the transverse tubes;

a plurality of first fasteners attaching the connectors to the transverse tubes;

a plurality of second fasteners attaching the connectors to the vertical tubes and to the horizontal tubes;

a plurality of third fasteners attaching the gussets to the vertical tubes and to the horizontal tubes; and a structural adhesive attaching the connectors to the transverse tubes, the vertical tubes, and the horizontal tubes, the structural adhesive attaching the gussets to the vertical tubes and to the horizontal tubes, and the structural adhesive attaching the resin frame panels to the metal alloy frame, so as to distribute forces over a larger area than with the fasteners alone, thereby reducing stress on the upright composite structure and the seat composite structure where the frame panels attach to the metal alloy frame and where the connectors and gussets attach to the metal alloy frame; wherein the structural adhesive combined with the fasteners is stronger than either one of the structural adhesive and the fasteners individually.

20. The marine seat assembly of claim 19, wherein:

the upright composite structure further comprises:

a plurality of fourth fasteners attaching the first polymer resin frame panel to the upright portion front, the fourth fasteners attaching the second polymer resin frame panel to the upright portion rear;

the structural adhesive attaching the first polymer resin frame panel to the upright portion front, the structural adhesive attaching the second polymer resin frame panel to the upright portion rear; and the seat composite structure further comprises:

the fourth fasteners attaching the third polymer resin frame panel to the seat portion top; and the structural adhesive attaching the third polymer resin frame panel to the seat portion top; wherein the structural adhesive combined with the fasteners is stronger than either one of the structural adhesive and the fasteners individually.

* * * * *